US009856063B1

(12) United States Patent
Schulz et al.

(10) Patent No.: US 9,856,063 B1
(45) Date of Patent: Jan. 2, 2018

(54) FLEXIBLE CONTAINER WITH COMFORT GRIP

(71) Applicant: Dow Global Technologies LLC, Midland, MI (US)

(72) Inventors: Peter J. Schulz, Midland, MI (US); Lamy J. Chopin, III, Missouri City, TX (US); Michelle L. Boven, Katy, TX (US); Jeffrey E. Bonekamp, Midland, MI (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

(21) Appl. No.: 15/198,744

(22) Filed: Jun. 30, 2016

(51) Int. Cl.

| | |
|---|---|
| ***B65D 33/10*** | (2006.01) |
| ***B65D 75/56*** | (2006.01) |
| ***B65D 75/58*** | (2006.01) |
| ***B65D 30/20*** | (2006.01) |

(52) U.S. Cl.
CPC ..... *B65D 75/566* (2013.01); *B65D 31/10* (2013.01); *B65D 75/5883* (2013.01)

(58) Field of Classification Search
CPC ... B65D 75/566; B65D 31/10; B65D 75/5883
USPC ..... 383/10, 6, 7, 16, 17, 20, 120
See application file for complete search history.

(56) References Cited

U.S. PATENT DOCUMENTS

| | | | | |
|---|---|---|---|---|
| 3,799,914 A | | 3/1974 | Schmit et al. | |
| 4,023,607 A | | 5/1977 | Jensen et al. | |
| 4,361,235 A | * | 11/1982 | Gautier | B65B 9/093 206/0.6 |
| 4,377,192 A | * | 3/1983 | Gautier | B65D 75/52 222/465.1 |
| 5,338,117 A | * | 8/1994 | Kucksdorf | B65D 33/08 229/204 |
| 5,677,383 A | | 10/1997 | Chum et al. | |
| 5,937,617 A | | 8/1999 | Yeager | |
| 5,976,300 A | | 11/1999 | Buchanan et al. | |
| 6,111,023 A | | 8/2000 | Chum et al. | |
| 6,149,555 A | * | 11/2000 | Kinback | A63B 21/0603 383/10 |
| 6,293,394 B1 | | 9/2001 | Marbler et al. | |
| 6,923,574 B2 | | 8/2005 | Siegel | |
| 6,984,695 B2 | | 1/2006 | Brown et al. | |
| 7,207,717 B2 | * | 4/2007 | Steele | B65D 33/01 383/10 |
| 8,002,468 B2 | | 8/2011 | Otsuka et al. | |
| 8,146,332 B2 | | 4/2012 | Slovencik | |

(Continued)

FOREIGN PATENT DOCUMENTS

| | | | | |
|---|---|---|---|---|
| DE | 20305297 U1 | | 6/2003 | |
| GB | 2227928 A | * | 8/1990 | B65D 33/08 |

(Continued)

*Primary Examiner* — Jes F Pascua
(74) *Attorney, Agent, or Firm* — Husch Blackwell LLP

(57) ABSTRACT

The present disclosure provides a flexible container. In an embodiment, the flexible container includes a front panel, a rear panel, a first gusseted side panel, and a second gusseted side panel, the gusseted side panels adjoining the front panel and the rear panel along (i) peripheral seals to form a chamber; and (ii) handle seals to form a handle, the handle located at an end of the chamber and including a pocket formed from the handle seals. The pocket contains a grip member.

18 Claims, 11 Drawing Sheets

(56) References Cited

U.S. PATENT DOCUMENTS

| | | | | |
|---|---|---|---|---|
| 8,231,029 | B2 * | 7/2012 | Peer | B65D 75/5883 220/754 |
| 8,348,509 | B2 | 1/2013 | Wilkes et al. | |
| 8,840,305 | B2 * | 9/2014 | Wilkes | B65D 75/008 383/10 |
| 8,992,084 | B2 | 3/2015 | Pellingra et al. | |
| 2004/0035865 | A1 * | 2/2004 | Rosen | B65D 75/008 220/4.01 |
| 2008/0199108 | A1 | 8/2008 | Rogers | |
| 2008/0253700 | A1 | 10/2008 | Sh | |
| 2010/0052350 | A1 | 3/2010 | Dunaif | |
| 2014/0119676 | A1 * | 5/2014 | Martin | B65D 75/5883 383/7 |
| 2014/0292011 | A1 | 10/2014 | Liszkiewicz | |

FOREIGN PATENT DOCUMENTS

| | | | | |
|---|---|---|---|---|
| JP | 4103331 | B2 | 6/2008 | |
| SE | WO 9941155 | A1 * | 8/1999 | B65B 1/02 |
| WO | 2009/016654 | A2 | 2/2009 | |

* cited by examiner

FLEXIBLE CONTAINER WITH COMFORT GRIP

BACKGROUND

The present disclosure is directed to a flexible container having a handle with a comfort grip.

Flexible packaging is known to offer significant value and sustainability benefits to product manufacturers, retailers and consumers as compared to solid, molded plastic packaging containers. Flexible packaging provides many consumer conveniences and benefits, including extended shelf life, easy storage, microwavability and refillability. Flexible packaging has proven to require less energy for creation and creates fewer emissions during disposal.

Flexible packaging includes flexible containers with a handle at the top and/or bottom of the container. The handle is formed from the flexible films, providing a handle that is itself flexible. Flexible handles are known to be uncomfortable for a user to grip, particularly when the container is heavy. Flexible handles also deform against the weight of the contents of the flexible container, which makes pouring the contents out of the container difficult.

A need exists for a flexible container with a handle that provides a comfort grip for a user. A need further exists for a flexible container with a handle having a grip member that is integral to the container.

SUMMARY

The present disclosure provides a flexible container. In an embodiment, the flexible container includes a front panel, a rear panel, a first gusseted side panel, and a second gusseted side panel, the gusseted side panels adjoining the front panel and the rear panel along (i) peripheral seals to form a chamber; and (ii) handle seals to form a handle, the handle located at an end of the chamber and including a pocket formed from the handle seals. The pocket contains a grip member.

DEFINITIONS

Figure 1:
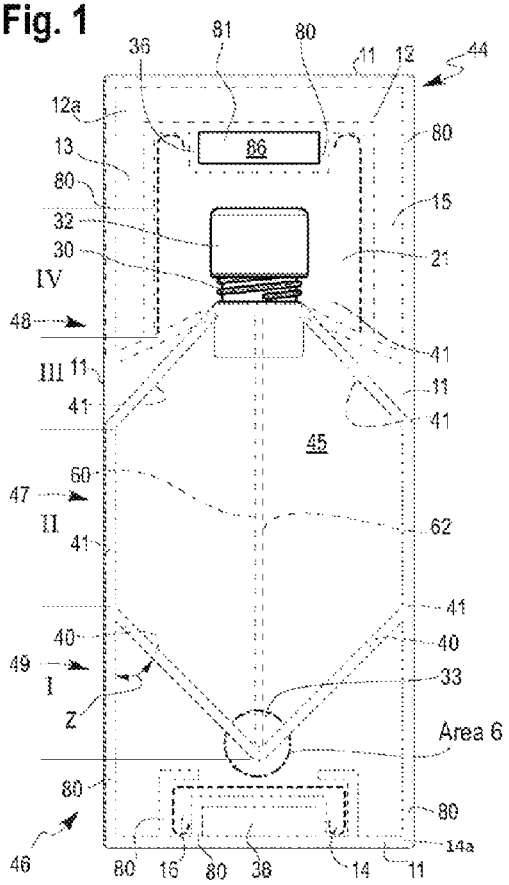
FIG. 1 is a front elevation view of a flexible container in a collapsed configuration in accordance with an embodiment of the present disclosure.

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

An "olefin-based polymer" is a polymer that contains more than 50 mole percent polymerized olefin monomer (based on total amount of polymerizable monomers), and optionally, may contain at least one comonomer. Non-limiting examples of olefin-based polymer include ethylene-based polymer and propylene-based polymer.

A "propylene-based polymer" is a polymer that contains more than 50 weight percent polymerized propylene monomer (based on the total weight of polymerizable monomers) and, optionally, may contain at least one comonomer.

An "ethylene-based polymer" is a polymer that contains more than 50 weight percent polymerized ethylene monomer (based on the total weight of polymerizable monomers) and, optionally, may contain at least one comonomer. Ethylene-based polymer includes ethylene homopolymer, and ethylene copolymer (meaning units derived from ethylene and one or more comonomers). The terms "ethylene-based polymer" and "polyethylene" may be used interchangeably. Non-limiting examples of ethylene-based polymer (polyethylene) include low density polyethylene (LDPE) and linear polyethylene. Non-limiting examples of linear polyethylene include linear low density polyethylene (LLDPE), ultra low density polyethylene (ULDPE), very low density polyethylene (VLDPE), multi-component ethylene-based copolymer (EPE), ethylene/α-olefin multi-block copolymers (also known as olefin block copolymer (OBC)), single-site catalyzed linear low density polyethylene (m-LLDPE), substantially linear, or linear, plastomers/elastomers, and high density polyethylene (HDPE). Generally, polyethylene may be produced in gas-phase, fluidized bed reactors, liquid phase slurry process reactors, or liquid phase solution process reactors, using a heterogeneous catalyst system, such as Ziegler-Natta catalyst, a homogeneous catalyst system, comprising Group 4 transition metals and ligand structures such as metallocene, non-metallocene metal-centered, heteroaryl, heterovalent aryloxyether, phosphinimine, and others. Combinations of heterogeneous and/or homogeneous catalysts also may be used in either single reactor or dual reactor configurations.

"High density polyethylene" (or "HDPE") is an ethylene homopolymer or an ethylene/α-olefin copolymer with at least one $C_4$-$C_{10}$ α-olefin comonomer, or $C_4$α-olefin comonomer and a density from greater than 0.94 g/cc, or 0.945 g/cc, or 0.95 g/cc, or 0.955 g/cc to 0.96 g/cc, or 0.97 g/cc, or 0.98 g/cc. The HDPE can be a monomodal copolymer or a multimodal copolymer. A "monomodal ethylene copolymer" is an ethylene/$C_4$-$C_{10}$ α-olefin copolymer that has one distinct peak in a gel permeation chromatography (GPC) showing the molecular weight distribution. A "multimodal ethylene copolymer" is an ethylene/$C_4$-$C_{10}$ α-olefin copolymer that has at least two distinct peaks in a GPC showing the molecular weight distribution. Multimodal includes copolymer having two peaks (bimodal) as well as copolymer having more than two peaks. Nonlimiting examples of HDPE include DOW™ High Density Polyethylene (HDPE) Resins (available from The Dow Chemical Company), ELITE™ Enhanced Polyethylene Resins (available from The Dow Chemical Company), CONTINUUM™ Bimodal Polyethylene Resins (available from The Dow Chemical Company), LUPOLEN™ (available from LyondellBasell), as well as HDPE products from Borealis, Ineos, and ExxonMobil.

"Low density polyethylene" (or "LDPE") consists of ethylene homopolymer, or ethylene/α-olefin copolymer comprising at least one $C_3$-$C_{10}$ α-olefin, preferably $C_3$-$C_4$ that has a density from 0.915 g/cc to 0.940 g/cc and contains long chain branching with broad MWD. LDPE is typically produced by way of high pressure free radical polymerization (tubular reactor or autoclave with free radical initiator). Nonlimiting examples of LDPE include MarFlex™ (Chevron Phillips), LUPOLEN™ (LyondellBasell), as well as LDPE products from Borealis, Ineos, ExxonMobil, and others.

"Linear low density polyethylene" (or "LLDPE") is a linear ethylene/α-olefin copolymer containing heterogeneous short-chain branching distribution comprising units derived from ethylene and units derived from at least one $C_3$-$C_{10}$ α-olefin comonomer or at least one $C_4$-$C_8$ α-olefin comonomer, or at least one $C_6$-$C_8$ α-olefin comonomer. LLDPE is characterized by little, if any, long chain branching, in contrast to conventional LDPE. LLDPE has a density from 0.910 g/cc, or 0.915 g/cc, or 0.920 g/cc, or 0.925 g/cc to 0.930 g/cc, or 0.935 g/cc, or 0.940 g/cc. Non limiting examples of LLDPE include TUFLIN™ linear low density polyethylene resins (available from The Dow Chemical Company), DOWLEX™ polyethylene resins (available from the Dow Chemical Company), and MARLEX™ polyethylene (available from Chevron Phillips).

"Ultra low density polyethylene" (or "ULDPE") and "very low density polyethylene" (or "VLDPE") each is a linear ethylene/α-olefin copolymer containing heterogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. ULDPE and VLDPE each has a density from 0.885 g/cc, or 0.90 g/cc to 0.915 g/cc. Nonlimiting examples of ULDPE and VLDPE include ATTANE™ ultra low density polyethylene resins (available form The Dow Chemical Company) and FLEXOMER™ very low density polyethylene resins (available from The Dow Chemical Company).

"Multi-component ethylene-based copolymer" (or "EPE") comprises units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer, such as described in patent references U.S. Pat. No. 6,111,023; U.S. Pat. No. 5,677,383; and U.S. Pat. No. 6,984,695. EPE resins have a density from 0.905 g/cc, or 0.908 g/cc, or 0.912 g/cc, or 0.920 g/cc to 0.926 g/cc, or 0.929 g/cc, or 0.940 g/cc, or 0.962 g/cc. Nonlimiting examples of EPE resins include ELITE™ enhanced polyethylene (available from The Dow Chemical Company), ELITE AT™ advanced technology resins (available from The Dow Chemical Company), SURPASS™ Polyethylene (PE) Resins (available from Nova Chemicals), and SMART™ (available from SK Chemicals Co.).

"Olefin block copolymers" (or "OBC") are ethylene/α-olefin multi-block copolymers comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer, such as INFUSE™ (available from The Dow Chemical Company) as described in U.S. Pat. No. 7,608,668. OBC resins have a density from 0.866 g/cc, or 0.870 g/cc, or 0.875 g/cc, or 0.877 g/cc to 0.880 g/cc, or 0.885, or 0.890 g/cc.

"Single-site catalyzed linear low density polyethylenes" (or "m-LLDPE") are linear ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. m-LLDPE has density from 0.913 g/cc, or 0.918 g/cc, or 0.920 g/cc to 0.925 g/cc, or 0.940 g/cc. Nonlimiting examples of m-LLDPE include EXCEED™ metallocene PE (available from ExxonMobil Chemical), LUFLEXEN™ m-LLDPE (available from LyondellBasell), and ELTEX™ PF m-LLDPE (available from Ineos Olefins & Polymers).

"Ethylene plastomers/elastomers" are substantially linear, or linear, ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. Ethylene plastomers/elastomers have a density from 0.870 g/cc, or 0.880 g/cc, or 0.890 g/cc to 0.900 g/cc, or 0.902 g/cc, or 0.904 g/cc, or 0.909 g/cc, or 0.910 g/cc, or 0.917 g/cc. Nonlimiting examples of ethylene plastomers/elastomers include AFFINITY™ plastomers and elastomers (available from The Dow Chemical Company), EXACT™ Plastomers (available from ExxonMobil Chemical), Tafmer™ (available from Mitsui), Nexlene™ (available from SK Chemicals Co.), and Lucene™ (available LG Chem Ltd.).

Density is measured in accordance with ASTM D 792.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

"Melting point" or "Tm" (also referred to as a melting peak in reference to the shape of the plotted DSC curve), as used herein, is typically measured by the DSC (Differential Scanning calorimetry) technique for measuring the melting points or peaks of polyolefins, as described in U.S. Pat. No. 5,783,638. It should be noted that many blends comprising two or more polyolefins will have more than one melting point or peak, many individual polyolefins will comprise only one melting point or peak.

DETAILED DESCRIPTION

The present disclosure provides a flexible container. In an embodiment, the flexible container includes a front panel, a rear panel, a first gusseted side panel, and a second gusseted side panel, the gusseted side panels adjoining the front panel and the rear panel along (i) peripheral seals to form a chamber and (ii) handle seals to form a handle. The handle is located at an end of the chamber. The handle includes a pocket formed from the handle seals. The pocket includes a grip member.

A. Panels

The present disclosure provides a flexible container including a front panel, a rear panel, a first gusseted side panel, and a second gusseted side panel.

FIGS. 1-5 depict flexible container 10 made from four panels, a first gusset panel 18, a second gusset panel 20, a front panel 22 and a rear panel 24. Each panel 18, 20, 22, 24 is a flexible multilayer film as discussed in detail below. During the fabrication process, the panels are formed when one or more webs of flexible multilayer film are sealed together. While the webs may be separate pieces of flexible multilayer film, it will be appreciated that any number of the seams between the webs could be "pre-made," as by folding one or more of the source webs to create the effect of a seam or seams. For example, if it were desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bladder configuration).

The four panels 18, 20, 22 and 24 each can be composed of a separate web of flexible multilayer film. The composition and structure for each web of flexible multilayer film can be the same or different. Alternatively, one web of flexible multilayer film may also be used to make all four panels and the top and bottom segments. In a further embodiment, two or more webs can be used to make each panel.

Figure 5:
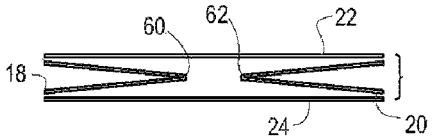
FIG. 5 is an elevation view of a panel sandwich in accordance with an embodiment of the present disclosure.

FIG. 5 shows the relative positions of the four webs as they form four panels (in a "one up" configuration) as they pass through the fabrication process. For clarity, the webs are shown as four individual panels, the panels separated and the heat seals not made. The constituent webs form a first gusset panel 18, a second gusset panel 20, a front panel 22 and a rear panel 24. Each panel 18, 20, 22, 24 is a flexible multilayer film. The gusset fold lines 60 and 62 are shown in FIGS. 1 and 5.

As shown in FIG. 5, the folded gusset panels 18, 20 are placed between the rear panel 24 and the front panel 22 to form a "panel sandwich." The gusset panel 18 opposes the gusset panel 20. The edges of the panels 18-24 are configured, or otherwise arranged, to form a common periphery 11, as shown in FIG. 1. The flexible multilayer film of each panel web is configured so that the heat seal layers, as discussed below, face each other. The common periphery 11 includes the bottom seal area including the bottom end of each panel.

Figure 2:
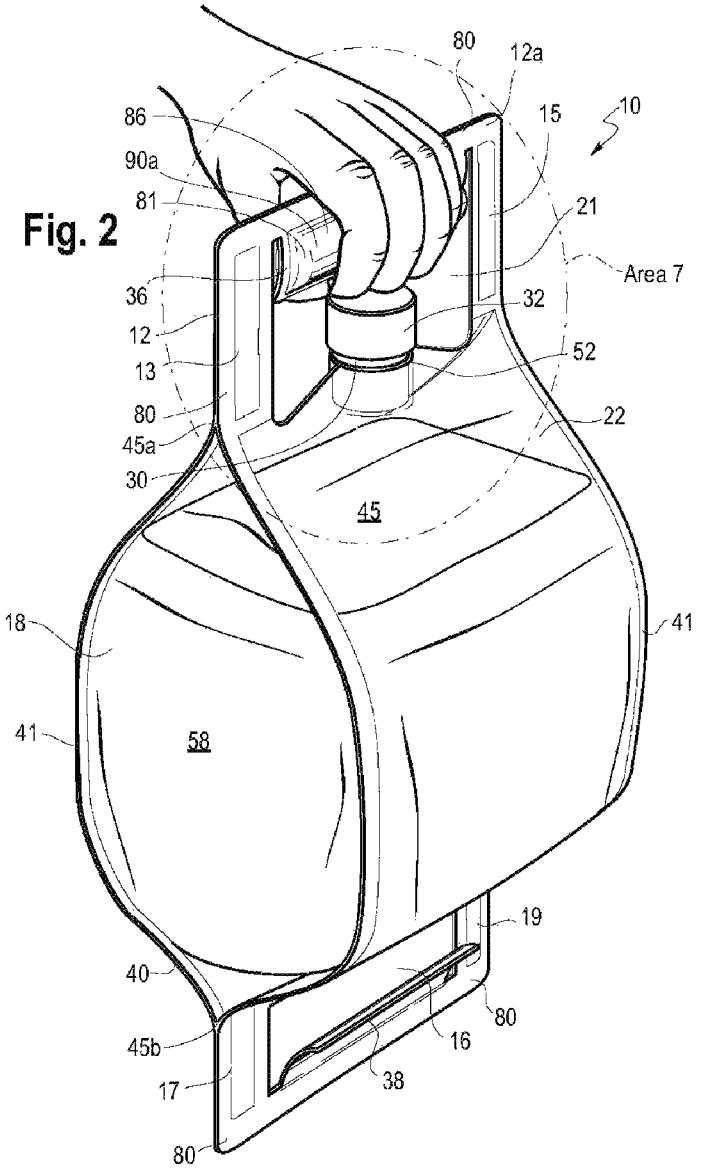
FIG. 2 is a perspective view of a flexible container in accordance with an embodiment of the present disclosure.
Figure 3:
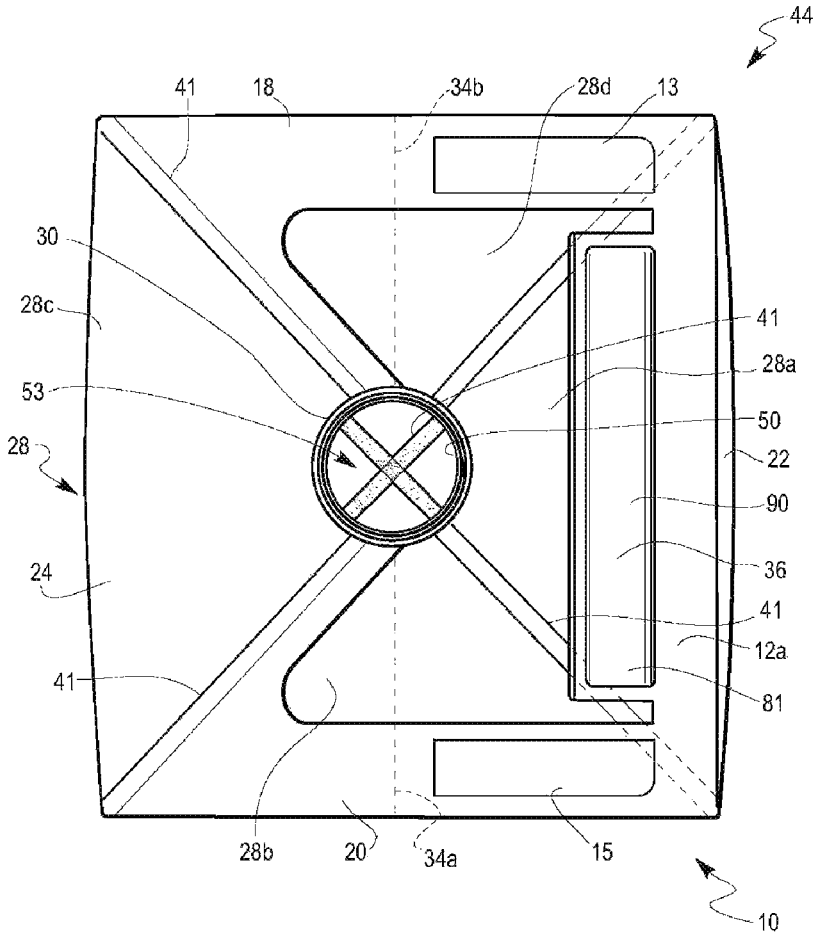
FIG. 3 is a top plan view of the flexible container of FIG. 2.
Figure 4:
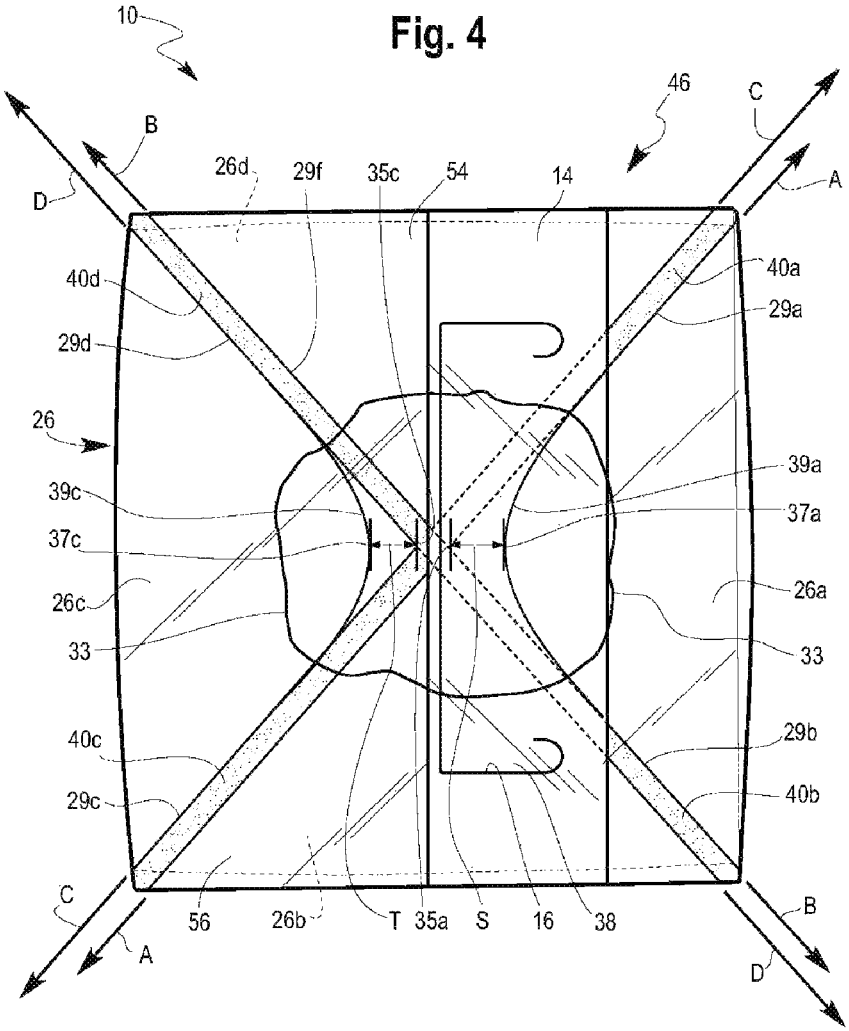
FIG. 4 is a bottom plan view of the flexible container of FIG. 2.

In an embodiment, the flexible container has a collapsed configuration (as shown in FIG. 1) and an expanded configuration (shown in FIGS. 2-4).

When the flexible container is in the collapsed configuration, the flexible container is in a flattened state, or in an otherwise evacuated state. The gusset panels 18, 20 fold inwardly (dotted gusset fold lines 60, 62 of FIG. 1) and are sandwiched by the front panel 22 and the rear panel 24.

FIG. 1 shows the flexible container 10 in the collapsed configuration. As shown in FIG. 1, the flexible container 10 has a bottom section I, a body section II, a tapered transition section III, and a neck section IV. In the expanded configuration, the bottom section I forms a bottom segment 26, as shown in FIG. 4. The body section II forms a body portion. The tapered transition section III forms a tapered transition portion. The neck section IV forms a neck portion.

FIGS. 2-4 show the flexible container 10 in the expanded configuration. The four panels 18, 20, 22, and 24 form the body section II and extend toward a top end 44 and extend toward a bottom end 46 of the container 10. Sections III and IV (respective tapered transition section, neck section) form a top segment 28. Section I (bottom section) forms a bottom segment 26.

In an embodiment, four webs of flexible multilayer film are provided, one web of film for each respective panel 18, 20, 22, and 24. The edges of each film are sealed to the adjacent web of film to form peripheral seals 41 and peripheral tapered seals 40*a*-40*d* (40) (FIGS. 1-4). The peripheral tapered seals 40*a*-40*d* are located on the bottom segment 26 of the flexible container as shown in FIG. 4, and have an inner edge 29*a*-29*f*. The peripheral seals 40 are located on the side edges of the container, as shown in FIG. 2. Consequently, the flexible container 10 includes a closed bottom section I, a closed body section II, and a closed tapered transition section III. Nonlimiting examples of suitable heating procedures include heat sealing and/or ultrasonic sealing. The closed bottom section I, closed body section II, and closed tapered transition section III form a chamber 45. The chamber 45 has a top end 45*a* and a bottom end 45*b*, as shown in FIG. 2.

To form the top segment 28 and the bottom segment 26, the four webs of flexible multilayer film converge together at the respective end and are sealed together. For instance, the top segment 28 can be defined by extensions of the panels sealed together at the tapered transition section III, and the neck section IV. The top end 44 includes four top panels 28*a*-28*d* (FIG. 3) of film that define the top segment 28. The bottom segment 26 can be defined by extensions of the panels sealed together at the bottom section I. The bottom segment 26 can also have four bottom panels 26*a*-26*d* of film sealed together and can also be defined by extensions of the panels at the opposite bottom end 46, as shown in FIG. 4.

As shown in FIGS. 1-4, the four panels of film that form the flexible container extend from the body section II (forming body 47), to the tapered transition section III (forming tapered transition portion 48), to form a neck (in the neck section IV). The four panels of film also extend from the body section II to the bottom section I (forming bottom portion 49).

The neck can be located at a corner of the body 47, or in one of the four panels 18, 20, 22, 24. In an embodiment, the neck is positioned at a midpoint of the top segment 28, as shown in FIGS. 1-3. The neck may (or may not) be sized smaller than a width of the body section II, such that the neck can have an area that is less than a total area of the top segment 28.

The neck includes a neck wall 50. FIG. 3 shows the neck wall 50 forms an access opening 53 for access into the flexible container interior.

In an embodiment, the neck is formed from two or more panels. In a further embodiment, the neck is formed from four panels. The neck can be sealed. The neck seal can be a tear seal. Alternatively, the neck seal can be a re-sealable seal. Nonlimiting examples of suitable re-sealable seals include peelable seal, a flap seal, an adhesive seal, and a zipper seal.

In an embodiment, a portion of the four webs of flexible multilayer film that make up the top segment 28 terminate at a spout 30, as shown in FIGS. 1 and 2. A portion of a top end section of each of the four webs of flexible multilayer film is sealed, or otherwise welded, to an outer, lower rim 52 of the spout 30 to form a tight seal, as shown in FIG. 2. The spout 30 is sealed to the flexible container by way of compression heat seal, ultrasonic seal, and combinations thereof. Although the base of spout 30 depicted in FIG. 2 has a circular cross-sectional shape, it is understood that the base of spout 30 can have other cross-sectional shapes such as a polygonal cross-sectional shape, for example. The base with circular cross-sectional shape is distinct from fitments with canoe-shaped bases used for conventional two-panel flexible pouches.

In an embodiment, the spout 30 excludes fitments with oval, wing-shaped, eye-shaped, or canoe-shaped bases.

The spout 30 can be made of a rigid construction and can be formed of any appropriate polymeric material, such as HDPE, OBC, or LDPE, and combinations thereof.

In an embodiment, the outer surface of the base of spout 30 has surface texture. The surface texture can include embossment and a plurality of radial ridges to promote sealing to the inner surface of the top segment 28, as shown in FIG. 3.

In an embodiment the spout 30 is located at the center or midpoint of the top segment 28, as shown in FIG. 3. The spout 30 has an access opening 53 through the top segment 28 into the interior of the flexible container 10. Alternatively, the spout 30 can be positioned on one of the panels, where the top segment would then be defined as an upper seal area defined by the joining together of at least two panel ends. In an embodiment, the spout 30 is sized smaller than a width of the container 10, such that the access opening 53 of the spout 30 can have an area that is less than a total area of the top segment 28. In a further embodiment, the spout area is not more than 20% of the total top segment area. This can ensure that the spout 30 and its associated access opening 53 will not be large enough to insert a hand therethrough, thus avoiding any unintentional contact with the product 58 stored therein.

In an embodiment, the spout 30 contains a removable closure 32. The removable closure 32 covers the access opening 53 and prevents the product 58 from spilling out of the container 10. The removable closure 32 may be a screw-on cap, a flip-top cap or other types of removable (and optionally reclosable) closures. In an embodiment, the spout 30 can be a flange style fitment installed in a hole of any one panel.

Each panel includes a respective bottom face. FIG. 4 shows four triangle-shaped bottom faces 26*a*-26*d*, each bottom face being an extension of a respective film panel. The bottom faces 26*a*-26*d* make up the bottom segment 26. The four panels 26*a*-26*d* come together at a midpoint of the bottom segment 26. The bottom faces 26*a*-26*d* are sealed together, such as by using a heat-sealing technology. For instance, a weld can be made to seal the edges of the bottom segment 26 together. Nonlimiting examples of suitable heat-sealing technologies include hot bar sealing, hot die sealing, impulse sealing, high frequency sealing, or ultrasonic sealing methods.

Figure 6:
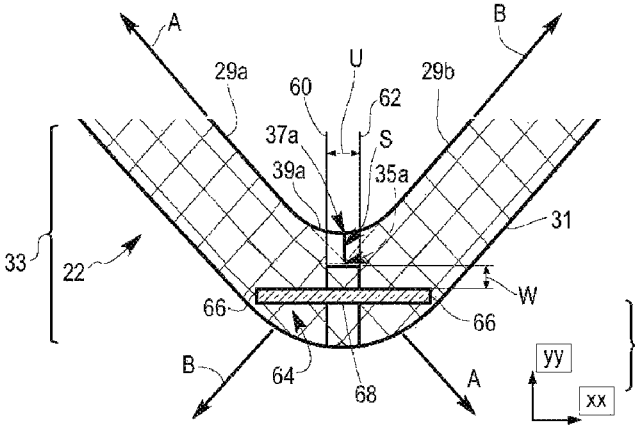
FIG. 6 is an enlarged view of Area 6 of FIG. 1.

FIG. 4 shows bottom segment 26. Each panel 18, 20, 22, 24 has a respective bottom face 26*a*-26*d* that is present in the bottom segment 26. Each bottom face is bordered by two opposing peripheral tapered seals 40*a*-40*d*. Each peripheral tapered seal 40*a*-40*d* extends from a respective peripheral seal 41. The peripheral tapered seals for the front panel 22 and the rear panel 24 have an inner edge 29*a*-29*d* (FIG. 4) and an outer edge 31 (FIG. 6). The peripheral tapered seals 40*a*-40*d* converge at a bottom seal area 33 (FIGS. 1, 4, 6).

The front panel bottom face 26*a* includes a first line A defined by the inner edge 29*a* of the first peripheral tapered seal 40*a* and a second line B defined by the inner edge 29*b* of the second peripheral tapered seal 40*b*, as shown in FIG. 4. The first line A intersects the second line B at an apex point 35*a* in the bottom seal area 33. The front panel bottom face 26*a* has a bottom distalmost inner seal point 37*a* ("BDISP 37*a*"). The BDISP 37*a* is located on the inner edge.

The apex point 35*a* is separated from the BDISP 37*a* by a distance S (FIGS. 4, 6) from 0 millimeter (mm) to less than 8.0 mm.

In an embodiment, the rear panel bottom face 26*c* includes an apex point 35*c* similar to the apex point 35*a* on the front panel bottom face 26*a*, as shown in FIG. 4. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on the inner edge. The apex point 35*c* is separated from the BDISP 37*c* by a distance T (FIG. 4) from 0 millimeter (mm) to less than 8.0 mm.

It is understood the following description to the front panel bottom face 26*a* applies equally to the rear panel bottom face 26*c*, with reference numerals to the rear panel bottom face 26*c* shown in adjacent closed parentheses.

In an embodiment, the BDISP 37*a* (37*c*) is located where the inner edges 29*a* (29*c*) and 29*b* (29*d*) intersect. The distance S (distance T) between the BDISP 37*a* (37*c*) and the apex point 35*a* (35*c*) is 0 mm.

In an embodiment, the inner seal edge diverges from the inner edges 29*a*, 29*b* (29*c*, 29*d*), to form an inner seal arc 39*a* (front panel) and inner seal arc 39*c* (rear panel), as shown in FIGS. 4 and 6. The BDISP 37*a* (37*c*) is located on the inner seal arc 39*a* (39*c*). The apex point 35*a* (35*c*) is separated from the BDISP 37*a* (37*c*) by the distance S (distance T), which is from greater than 0 mm, or 0.5 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 37*a* (37*c*) by the distance S (distance T) which is from greater than 0 mm to less than 6.0 mm.

In an embodiment, the distance S (distance T) from the apex point 35*a* (35*c*) to the BDISP 37*a* (37*c*) is from greater than 0 mm, or 0.5 mm, or 1.0 mm, or 2.0 mm to 4.0 mm or 5.0 mm or less than 5.5 mm.

In an embodiment, apex point 35*a* (35*c*) is separated from the BDISP 37*a* (37*c*) by the distance S (distance T), which is from 3.0 mm, or 3.5 mm, or 3.9 mm to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

In an embodiment, each peripheral tapered seal 40*a*-40*d* (outside edge) and an extended line from respective peripheral seal 41 (outside edge) form an angle Z, as shown in FIG. 1. The angle Z is from 40°, or 42°, or 44°, or 45° to 46°, or 48°, or 50°. In an embodiment, angle Z is 45°.

The bottom segment 26 includes a pair of gussets 54 and 56 formed there at, which are essentially extensions of the bottom faces 26*a*-26*d*, as shown in FIG. 4. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom segment 26, where the gussets 54 and 56 can contact bottom faces 26*b* and 26*d* covering them, while bottom segment panels 26*a* and 26*c* remain exposed at the bottom end 46.

FIG. 6 shows an enlarged view of the bottom seal area 33 (Area 6) of FIG. 1 and the front panel 26*a*. The fold lines 60 and 62 of respective gusset panels 18, 20 are separated by a distance U that is from 0 mm, or greater than 0 mm, or 0.5 mm, or 1.0 mm, or 2.0 mm, or 3.0 mm, or 4.0 mm, or 5.0 mm to 12.0 mm, or greater than 60.0 mm (for larger containers, for example). In an embodiment, distance U is from greater than 0 mm to less than 6.0 mm. FIG. 6 shows line A (defined by inner edge 29*a*) intersecting line B (defined by inner edge 29*b*) at apex point 35*a*. BDISP 37*a* is on the distal inner seal arc 39*a*. Apex point 35*a* is separated from BDISP 37*a* by a distance S having a length from greater than 0 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 6, an overseal 64 is formed where the four peripheral tapered seals 40*a*-40*d* converge in the bottom seal area 33. The overseal 64 includes 4-ply portions 66, where a portion of each panel is heat sealed to a portion of every other panel. Each panel represents 1-ply in the 4-ply heat seal. The overseal 64 also includes a 2-ply portion 68 where two panels (front panel 22 and rear panel 24) are sealed together. Consequently, the "overseal," as used herein, is the area where the peripheral tapered seals 40*a*-40*d* converge that is subjected to a subsequent heat seal operation (and subjected to at least two heat seal operations altogether). The overseal 64 is located in the peripheral tapered seals 40*a*-40*d* and does not extend into the chamber of the flexible container 10.

In an embodiment, the apex point 35*a* is located above the overseal 64. The apex point 35*a* is separated from, and does not contact the overseal 64. The BDISP 37*a* is located above the overseal 64. The BDISP 37*a* is separated from and does not contact the overseal 64.

In an embodiment, the apex point 35*a* is located between the BDISP 37*a* and the overseal 64, wherein the overseal 64 does not contact the apex point 35*a* and the overseal 64 does not contact the BDISP 37*a*.

The distance between the apex point 35*a* to the top edge of the overseal 64 is defined as distance W, shown in FIG. 6. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

In an embodiment, the flexible container 10 has a volume from 0.25 liters (L), or 0.5 L, or 0.75 L, or 1.0 L, or 1.5 L, or 2.5 L, or 3 L, or 3.5 L, or 3.78 L or 4.0 L, or 4.5 L or 5.0 L to 6.0 L, or 7.0 L, or 8.0 L, or 9.0 L or 10.0 L, or 20 L, or 30 L.

1. Flexible Multilayer Film

Each panel 18, 20, 22, 24 is composed of a flexible multilayer film. In an embodiment, each panel 18, 20, 22, 24 is made from a flexible film having at least one, or at least two, or at least three layers. The flexible film is resilient, flexible, deformable, and pliable. The structure and composition of the flexible film for each panel 18, 20, 22, 24 may be the same or different. For example, each of the panels 18, 20, 22, 24 can be made from a separate web, each web having a unique structure and/or unique composition, finish, or print. Alternatively, each of the panels 18, 20, 22, 24 can be the same structure and the same composition.

The flexible multilayer film is composed of a polymeric material. Nonlimiting examples of suitable polymeric material include olefin-based polymer; propylene-based polymer; ethylene-based polymer; polyamide (such as nylon), ethylene-acrylic acid or ethylene-methacrylic acid and their ionomers with zinc, sodium, lithium, potassium, or magnesium salts; ethylene vinyl acetate (EVA) copolymers; and blends thereof. The flexible multilayer film can be either printable or compatible to receive a pressure sensitive label or other type of label for displaying of indicia on the flexible container 10.

In an embodiment, a flexible multilayer film is provided and includes at least three layers: (i) an outermost layer, (ii) one or more core layers, and (iii) an innermost seal layer.

The outermost layer (i) and the innermost seal layer (iii) are surface layers with the one or more core layers (ii) sandwiched between the surface layers. The outermost layer may include (a-i) a HDPE, (b-ii) a propylene-based polymer, or combinations of (a-i) and (b-ii), alone, or with other olefin-based polymers such as LDPE. Nonlimiting examples of suitable propylene-based polymers include propylene homopolymer, random propylene/α-olefin copolymer (majority amount propylene with less than 10 weight percent ethylene comonomer), and propylene impact copolymer (heterophasic propylene/ethylene copolymer rubber phase dispersed in a matrix phase).

With the one or more core layers (ii), the number of total layers in the present multilayer film can be from three layers (one core layer), or four layers (two core layers), or five layers (three core layers, or six layers (four core layers), or seven layers (five core layers) to eight layers (six core layers), or nine layers (seven core layers), or ten layers (eight core layers), or eleven layers (nine core layers), or more.

The multilayer film has a thickness from 75 microns, or 100 microns, or 125 microns, or 150 microns to 200 microns, or 250 microns or 300 microns or 350 microns, or 400 microns.

The multilayer can be (i) coextruded, (ii) laminated, or (iii) a combination of (i) and (ii). In an embodiment, the multilayer film is a coextruded multilayer film.

In an embodiment, the outermost layer includes a HDPE. In a further embodiment, the HDPE is an EPE.

In an embodiment, each core layer includes one or more linear or substantially linear ethylene-based polymers or block copolymers having a density from 0.908 g/cc, or 0.912 g/cc, or 0.92 g/cc, or 0.921 g/cc, to 0.925 g/cc, or less than 0.93 g/cc. In an embodiment, each of the one or more core layers includes one or more ethylene/$C_3$-$C_8$ α-olefin copolymers selected from LLDPE, ULDPE, VLDPE, EPE, OBC, plastomers/elastomers, and m-LLDPE.

In an embodiment, the seal layer includes one or more ethylene-based polymer having a density from 0.86 g/cc, or 0.87 g/cc, or 0.875 g/cc, or 0.88 g/cc, or 0.89 g/cc, to 0.90 g/cc, or 0.902 g/cc, or 0.91 g/cc, or 0.92 g/cc. In an embodiment, the seal layer includes one or more ethylene/$C_3$-$C_8$ α-olefin copolymer selected from EPE, plastomers/elastomers, or m-LLDPE.

Each layer in the multilayer film may include one or more optional additives. Non-limiting examples of suitable additives include stabilizers, slip additives, antiblocking additives, process aids, clarifiers, nucleators, pigments or colorants, fillers and reinforcing agents. It is particularly useful to choose additives and polymeric materials that have suitable organoleptic and or optical properties.

In an embodiment, each panel 18, 20, 22, 24 is a flexible multilayer film having the same structure and the same composition.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cm$^3$, or from 0.875 to 0.910 g/cm$^3$, or from 0.888 to 0.900 g/cm$^3$ and an outermost layer composed of a material selected from LLDPE, OPET (biaxially oriented polyethylene terephthalate), OPP (oriented polypropylene), BOPP (biaxially oriented polypropylene), polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is composed of a material selected from LLDPE, OPET, OPP, BOPP, polyamide, and combinations thereof.

In an embodiment, the flexible multilayer film is a coextruded (or laminated) five layer film, or a coextruded (or laminated) seven layer film having at least two layers containing an ethylene-based polymer. The ethylene-based polymer may be the same or different in each layer.

In an embodiment, the flexible multilayer film is a coextruded and/or laminated five layer, or a coextruded (or laminated) seven layer film having at least one layer containing a material selected from LLDPE, OPET, OPP, BOPP, and polyamide.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

2. Flowable Substances

The flexible container 10 can be used to store any number of flowable substances therein. In particular, a flowable food product 58 can be stored within the flexible container 10, as shown in FIG. 2. In one aspect, flowable food products 58 such as salad dressings; sauces; dairy products; mayonnaise; mustard; ketchup; other condiments; syrup; beverages such as water, juice, milk, carbonated beverages, beer, or wine; animal feed; pet feed; and the like can be stored inside of the flexible container 10.

The flexible container 10 is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

B. Handle

The present flexible container includes a handle. In an embodiment, the gusseted side panels adjoin the front panel and the rear panel along handle seals to form a handle. The handle is located at an end of the chamber. The handle includes a pocket formed from the handle seals. The pocket includes a grip member.

A "handle" is a portion of one or more of the panels conformed to allow a user to grip the flexible container. The handle may be a top handle or a bottom handle. As used herein, a "top handle" is located at the top end of the chamber (adjacent the spout), and a "bottom handle" is located at the bottom end of the chamber (opposite end from spout). When the container 10 is inverted, the top and bottom positions in relation to the chamber 45 change. However, for consistency the handle adjacent the spout 30 is referred to as the top handle 12 and the opposite handle is referred to the bottom handle 14.

The handle is formed from a handle seal. The "handle seal" includes portions of the panels formed from multilayer film extending above and/or below the chamber of the flexible container that are sealed together. The bottom handle 14 and the top handle 12 and can comprise up to four plys of multilayer film sealed together with a handle seal 80 for a four panel container 10. When more than four panels are used to make the flexible container, the handles 12, 14 can include up to the same number of panels used to produce the flexible container. Any portion of the handles 12, 14 where all four plys are not completely sealed together by the heat-sealing method, can be adhered together in any appropriate manner, such as by a tack seal to form a fully-sealed multilayer handle. Alternatively, the handle 12, 14 can be made from as few as a single ply of film from one panel only or can be made from only two plies of multilayer film from two panels. The handles 12,14 can have any suitable shape and generally will take the shape of the multilayer film end. For example, typically the web of multilayer film has a rectangular shape when unwound, such that its ends have a straight edge. Therefore, the handles 12, 14 would also have a rectangular shape.

Although FIGS. 1 and 2 show the flexible container 10 with a top handle 12 and a bottom handle 14, it is understood the flexible container may be fabricated with only one handle.

1. Top Handle

In an embodiment, the flexible container includes a top handle located at the top end of the chamber, as shown in FIG. 2.

As shown in FIGS. 1, 2, 3, and 7, the top handle 12 extends from the top segment 28 and, in particular, extends from the four panels 28*a*-28*d* that make up the top segment 28. The four panels 28*a*-28*d* of film that extend into the top handle 12 are all sealed together with a handle seal 80 to form the top handle 12. For instance, a weld can be made to form the handle seal 80 and the top handle 12, and to seal the edges of the four panels 28*a*-28*d* of film together. Nonlimiting examples of suitable heat-sealing technologies include hot bar sealing, hot die sealing, impulse sealing, high frequency sealing, or ultrasonic sealing methods. The top handle 12 is located at the top end of the chamber 45*a*, as shown in FIG. 2.

The top handle 12 can have a U-shape and, in particular, an upside down U-shape with a horizontal upper handle portion 12*a* having two pairs of spaced legs 13 and 15 extending therefrom. The pair of legs 13 and 15 extend from the top segment 28, adjacent to the neck.

A portion of the top handle 12 extends above the neck and above the top segment 28 when the top handle 12 is extended in a position perpendicular to the top segment 28. The entire upper handle portion 12*a* can be moved above the spout 30. The two pairs of legs 13 and 15 along with the upper handle portion 12*a* together make up the top handle 12 surrounding a top handle opening 21 that allows a user to place her hand therethrough and grasp the upper handle portion 12*a*. The top handle 12 may or may not contain a top handle opening 21 or cutout section therein sized to fit a user's hand, as seen in FIG. 1. The top handle opening 21 can be any shape that is convenient to fit the hand and, in one aspect, the top handle opening 21 can have a generally oval shape. In another embodiment, the top handle opening 21 can have a generally rectangular shape.

The top handle 12 can contain a dead machine fold 34*a*, 34*b* that provides for the handle 12 to consistently fold in the same direction, as illustrated in FIG. 3. The dead machine fold 34*a*, 34*b* permits folding in a first direction toward the front side panel 22 and restricts folding in a second direction toward the rear side panel 24, as shown in FIG. 3. The term "restricts" as used throughout this application, can mean that it is easier to move in one direction, or the first direction, than in an opposite direction, such as the second direction. The machine fold 34*a*, 34*b* can be located in each of the pair of legs 13, 15 at a location where the handle seal 80 begins. The machine fold 34*a*, 34*b* in the top handle 12 can allow for the top handle 12 to be inclined to fold or bend consistently in the same first direction towards the front panel 22 as the bottom handle 14, rather than in the second direction towards the rear panel 24.

Figure 1A:
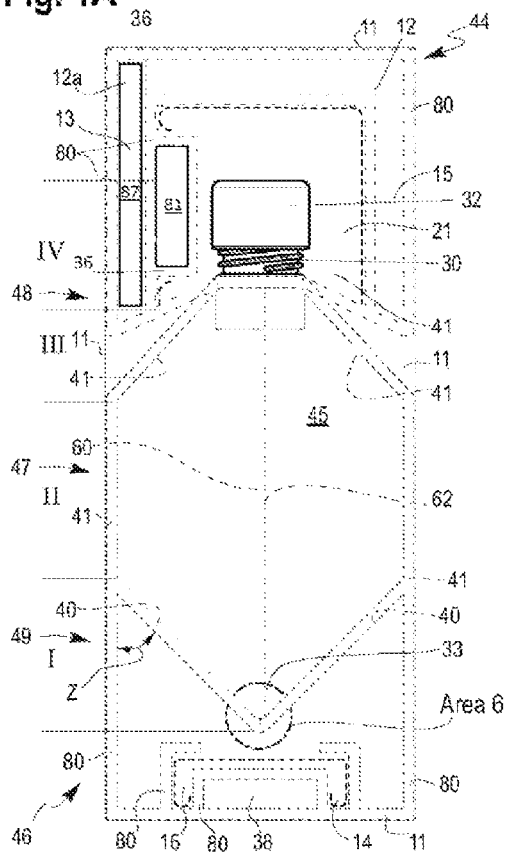
FIG. 1A is a front elevation view of a flexible container in a collapsed configuration in accordance with an embodiment of the present disclosure.

The top handle opening 21 of the top handle 12 may or may not have a flap 36 that comprises the cut material that forms the top handle opening 21, as shown in FIGS. 1, 1A and 2. To define the top handle opening 21, the top handle 21 can have a section that is cut out of the multilayer top handle 12 along three sides or portions while remaining attached at a fourth side, such as the upper handle portion 12*a*, the leg 13, or the leg 15. This provides a flap of material 36 that can be pushed through the top handle opening 21 by the user upward toward the upper handle portion 12*a*, and folded over an edge of the top handle opening 21 to provide a relatively smooth gripping surface at an edge that contacts the user's hand. If the flap of material 36 were completely cut out, this would leave an exposed fourth side or upper edge that could be relatively sharp and could possibly cut or scratch the hand when placed there. In an embodiment, the flap of material 36 is formed from the handle seal 80. In an embodiment, the top handle 12 includes a flap portion 36. In an embodiment, the top handle 12 includes one, two, or three flap portions 36. In an embodiment, the top handle 12 includes a flap portion 36 attached at the upper handle portion 12*a*, as shown in FIG. 1. In another embodiment, the top handle 12 includes a flap portion 36 attached at one or both of the legs 13, 15. Although FIG. 1A shows a flap portion 36 attached to leg 13, it is understood that the flap portion can be located along leg 15, or along each of leg 13 and leg 15.

In an embodiment, the top handle 12 excludes a flap portion 36.

2. Bottom Handle

In an embodiment, the flexible container includes a bottom handle located at the bottom end of the chamber, as shown in FIG. 2.

As shown in FIGS. 1, 2, 4, and 10-12, the flexible bottom handle 14 can be positioned at a bottom end 46 of the container such that the bottom handle 14 is an extension of the bottom segment 26, and, in particular, can extend from the four bottom faces 26*a*-26*d* that make up the bottom segment 26, as shown in FIG. 4. The four panels 26*a*-26*d* come together at a midpoint of the bottom segment 26. The bottom faces 26*a*-26*d* are sealed together, such as by using a heat-sealing technology, to form a handle seal 80 that forms the bottom handle 14. For instance, a weld can be made to form the handle seal 80 and the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods. The bottom handle 14 is located at the bottom end of the chamber 45*b*, as shown in FIG. 2.

As shown in FIG. 4, the gussets 54 and 56 of the flexible container 10 can further extend into the bottom handle 14. In the aspect where the gussets 54 and 56 are positioned adjacent to bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The bottom handle 14 can have a U-shape with a horizontal lower handle portion 14*a* having two pairs of spaced legs 17 and 19 extending therefrom, as shown in FIG. 2. The pair of legs 17 and 19 extend from the bottom segment 26.

The bottom handle 14 may or may not contain a bottom handle opening 16 or cutout section therein sized to fit a user's hand, as seen in FIG. 1. The bottom handle opening 16 can be any shape that is convenient to fit the hand and, in one aspect, the bottom handle opening 16 can have a generally oval shape. In another embodiment, the bottom handle opening 16 can have a generally rectangular shape.

The bottom handle opening 16 of the bottom handle 14 may or may not have a flap 38 that comprises the cut material that forms the bottom handle opening 16. To define the bottom handle opening 16, the bottom handle 14 can have a section that is cut out of the multilayer bottom handle 14 along three sides or portions while remaining attached at a fourth side, such as the lower handle portion 14*a*, the leg 17, or the leg 19. This provides a flap of material 38 that can be pushed through the bottom handle opening 16 by the user downward toward the lower handle portion 14*a*, and folded over an edge of the bottom handle opening 16 to provide a relatively smooth gripping surface at an edge that contacts the user's hand. If the flap of material 38 were completely cut out, this would leave an exposed fourth side or lower edge that could be relatively sharp and could possibly cut or scratch the hand when placed there. In an embodiment, the flap of material 38 is formed from the handle seal 80. In an embodiment, the bottom handle 14 includes one, two, or three flap portions 38. In an embodiment, the bottom handle 14 includes a flap portion 38 attached at the lower handle portion 14*a*, as shown in FIG. 1. In another embodiment, the bottom handle 14 includes a flap portion 38 attached at one or both of the legs 17, 19.

In an embodiment, the bottom handle 14 excludes a flap portion 38.

In another embodiment, the bottom handle 14 excludes a flap portion 38 and the top handle 12 excludes a flap portion 36.

As the flexible container 10 is evacuated and less product 58 remains, the bottom handle 14 can continue to provide support to help the flexible container 10 to remain standing upright unsupported and without tipping over. Because the bottom handle 14 is sealed generally along its entire length extending between the pair of gusset panels 18 and 20 with a handle seal 80, it can help to keep the gussets 54 and 56 (FIG. 4) together and continue to provide support to stand the container 10 upright, even as the container 10 is emptied.

In an embodiment, the bottom handle 14 contains a machine fold that also allows it to fold consistently in the same first direction towards the front panel 22 as the top handle 12.

When the container 10 is in a rest position, such as when it is standing upright on its bottom segment 26, the bottom handle 14 can be folded underneath the container 10 along a bottom machine fold in the first direction towards the front panel 22, so that it is parallel to the bottom segment 26 and adjacent bottom panel 26*a*, and the top handle 12 will automatically fold along its machine fold 34*a*, 34*b* in the same first direction towards the front panel 22, with a front surface of the top handle 12 parallel to a panel 28*a* of the top segment 28. The top handle 12 folds in the first direction towards the front panel 22, rather than extending straight up, perpendicular to the top segment 28, because of the machine fold 34*a*, 34*b*. Both handles 12 and 14 are inclined to fold in the same direction towards the front panel 22, such that upon dispensing, the handles can fold the same direction, relatively parallel to its respective end panel or end segment, to make dispensing easier and more controlled. Therefore, in a rest position, the handles 12 and 14 are both folded generally parallel to one another. Additionally, the container 10 can stand upright even with the bottom handle 14 positioned underneath the upright container 10.

3. Pocket Including a Grip Member

The present flexible container includes at least one handle, the at least one handle including at least one pocket formed from the handle seals. The pocket includes a grip member.

A "pocket" is a void volume sandwiched between at least two panels that is formed by the handle seal, which at least partially, or fully, surrounds the void volume. The pocket is located within the handle. FIG. 1 shows a pocket 86 in the top handle 12 that is surrounded by the handle seal 80. It is understood the following description to the top handle 12 pocket applies equally to the bottom handle 14 pocket, with reference numerals to the bottom handle 14 pocket shown in adjacent closed parentheses.

The pocket 86 may be a short pocket, a long pocket, a side pocket or a U-shaped pocket.

Figure 11:
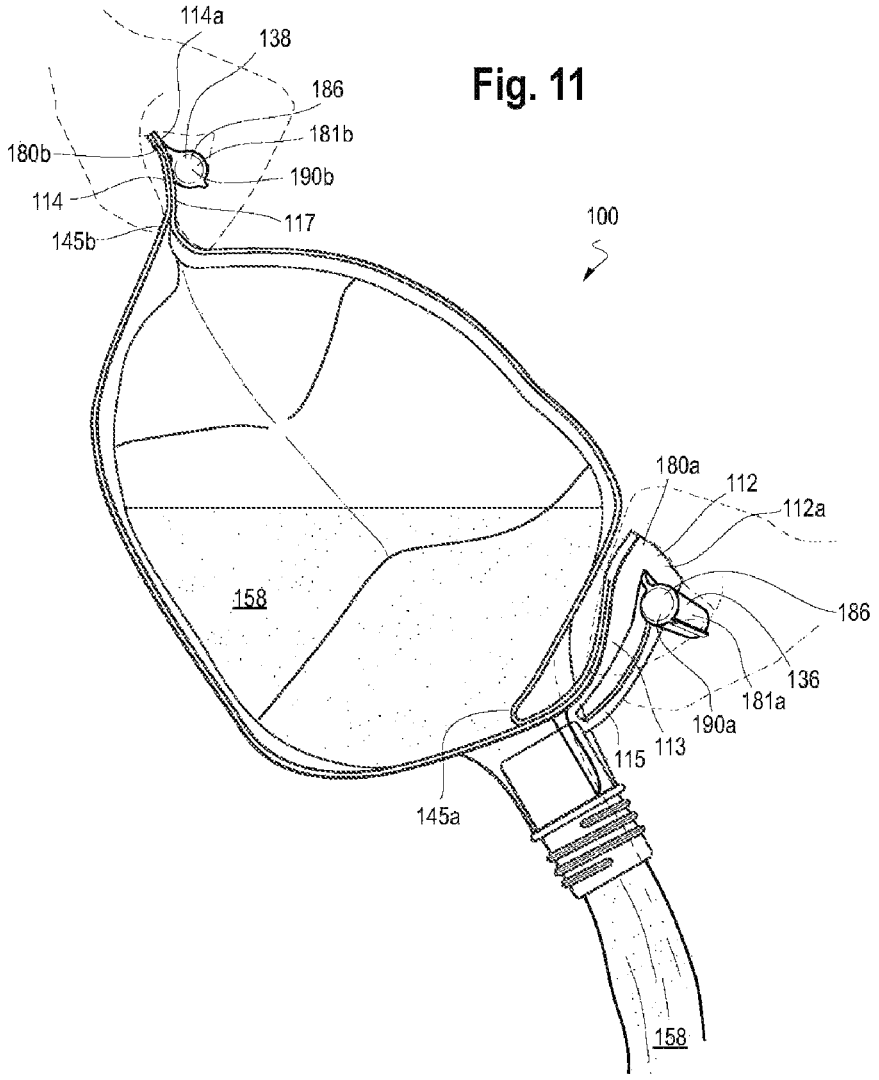
FIG. 11 is a perspective view of a flexible container in an inverted position for transferring the contents in accordance with an embodiment of the present disclosure.

A "short pocket" refers to a void volume formed from the handle seal 80 and at least two panels in the flap portion 36 (38) of the top handle 12 (14), as shown in FIGS. 1, 1A and 2 (FIG. 11). The short pocket 81 (81*a*) extends parallel respective to the upper handle portion 12*a* (14*a*) of the top handle 12 (14) when the flap portion 36 (38) is attached to the upper handle portion 12*a* (14*a*). When the flap portion 36 (38) is attached to a leg 13, 15 (17, 19), the short pocket 81 (81*a*) extends parallel to the respective leg 13, 15 (17, 19). The short pocket 81 can have a collapsed ovoid shape or a collapsed polygonal shape. In an embodiment, the short pocket 81 has a collapsed polygonal shape, as shown in FIG. 1. A "polygonal shape" is a closed-plane figure bounded by at least three sides. Nonlimiting examples of suitable polygonal shapes include triangle, square, rectangle, parallelogram, hexagon and octagon. The short pocket 81 depicted in FIG. 1 has a rectangular collapsed shape. The short pocket 81 depicted in FIG. 1A has a rectangular collapsed shape. In an embodiment, the handle includes one pocket that is a short pocket.

A "long pocket" refers to a void volume formed from the handle seal 80 and at least two panels in the upper handle portion 12*a* (14*a*) of the top handle 12 (14). The long pocket can have a collapsed ovoid shape or a collapsed polygonal shape. In an embodiment, the handle includes one pocket that is a long pocket.

A "side pocket" refers to a void volume formed from the handle seal 80 and at least two panels in a leg 13, 15 (17, 19) of the top handle 12 (14). The side pocket 87 can have a collapsed ovoid shape or a collapsed polygonal shape. In an embodiment, the handle includes one pocket that is a side pocket. The side pocket 87 can be in one or both of the legs 13, 15 (17, 19). Although FIG. 1A shows a side pocket 87 in leg 13, it is understood that the side pocket 87 can be located in legs 15, 17, and/or 19. In an embodiment, the handle includes one pocket that is a side pocket. In another embodiment, the flexible container 10 includes a side pocket 87 in one or both of the legs 13, 15 of the top handle 12. In another embodiment, the flexible container 10 includes a side pocket 87 in one or both of the legs 15, 17 of the bottom handle 14.

A "U-shaped pocket" refers to a void volume formed from the handle seal 80 and at least two panels in upper handle portion 12*a* (14*a*) and in each of the pair of legs 13, 15 (17, 19). The U-shaped pocket extends into at least a portion of each of the pair of legs 13, 15 (17, 19). In an embodiment, the handle includes one pocket that is a U-shaped pocket.

It is understood that the present flexible container may contain a plurality of pockets in the top handle 12 and/or the bottom handle 14. For example, the top handle 12 may contain a short pocket 81 and a long pocket, or a short pocket 81 and a U-shaped pocket. In an embodiment, the handle includes a plurality of pockets. In another embodiment, the top handle 12 and/or the bottom handle 14 includes one and only one pocket.

In an embodiment, the flexible container 10 includes one handle, the one handle including one pocket 86. In another embodiment, the flexible container 10 includes one handle, the one handle including a plurality of pockets 86. In another embodiment, the flexible container 10 includes a top handle 12 and a bottom handle 14, and one or both of the top handle 12 and the bottom handle 14 includes at least one pocket 86.

The pocket 86 contains a grip member. A "grip member" is a material with a mass and a volume that provides comfort to a user when a user's hand grasps the pocket. The grip member is a material that adds volume to the pocket. The grip member may be a pre-formed tube, a foam, a gel, or a gas, and combinations thereof.

In an embodiment, the grip member 90 is inserted into the pocket 86 through an opening in the handle seal 80. In another embodiment, the grip member 90 is injected into the pocket 86 through an opening in the handle seal 80. The opening in the handle seal 80 may or may not be sealed to form a hermetic seal around the pocket 86 containing the grip member 90. In an embodiment, the handle seal 80 forms a hermetic seal surrounding the pocket 86 containing the grip member 90. In another embodiment, a portion of the pocket 86 is unsealed such that the interior of the pocket 86 is in fluid communication with the environment.

i. Pre-Formed Tube Grip Member

In an embodiment, the grip member 90 is a pre-formed tube. A "pre-formed tube" is a cylindrical member that is fabricated prior to placement in the pocket. The pre-formed tube may be solid or hollow. Nonlimiting examples of suitable materials for the pre-formed tube include foam (such as polyurethane foam, polyethylene foam, ethylene/propylene/diene terpolymer foam, and any other foam disclosed herein), polyamide (such as nylon), silicon, natural rubber, synthetic rubber (such as nitrile rubber (an acrylonitrile/butadiene copolymer) ora thermoplastic elastomer such as an olefin-based elastomer (such as those commercially available under the tradename ENGAGE from The Dow Chemical Company, for example)), neoprene, polyvinyl chloride, and olefin-based polymer (such as LDPE and HDPE). In an embodiment, the pre-formed tube is a hollow foam tube. In an another embodiment, the pre-formed tube is a hollow olefin-based polymer tube.

Figure 7:
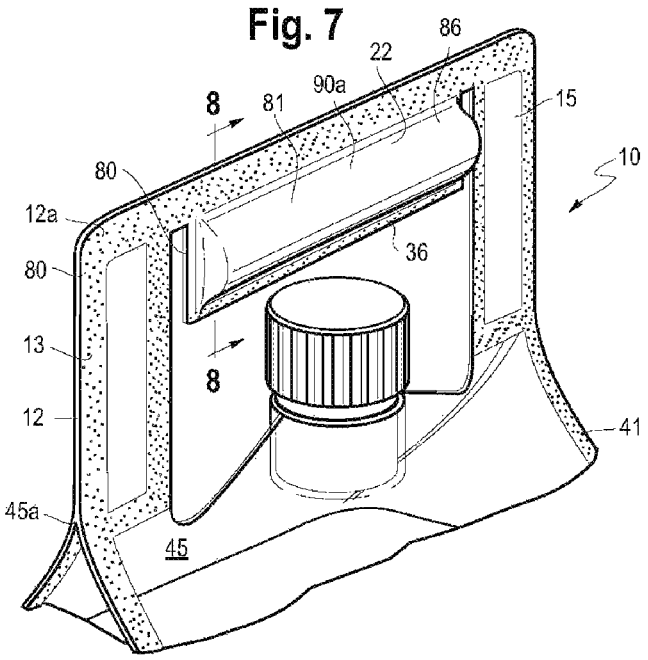
FIG. 7 is an enlarged perspective view of Area 7 of FIG. 2.
Figure 8:
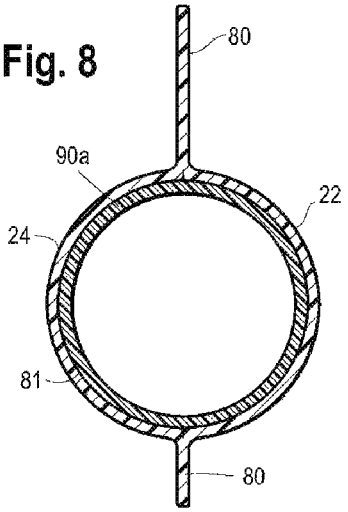
FIG. 8 is a sectional view taken along the line 8-8 of FIG. 7.

FIGS. 2 and 7-8 depict a flexible container 10 with a top handle 12 and a bottom handle 14 each formed from the handle seal 80, the top handle 12 including a short pocket 81 that contains pre-formed hollow tube grip member 90*a*. The short pocket 81 is contained within the flap portion 36 of the top handle 12. As shown in FIG. 7, the short pocket 81 is formed from the front panel 22 and the rear panel 24, and the handle seal 80. The pre-formed hollow tube grip member 90*a* has a cylindrical shape. The pre-formed hollow tube grip member 90*a* is contained within the short pocket 81, indicating the pre-formed hollow tube grip member 90*a* is integral to the flexible container 10. When a user grips the top handle 12 with a short pocket 81 containing pre-formed hollow tube grip member 90*a*, the flap portion 36 folds upwards toward the upper handle portion 12*a* of the top handle 12 to create a smooth gripping surface of the top handle 12, and the pre-formed hollow tube grip member 90*a* creates a cushioned gripping surface of the top handle 12.

Figure 10:
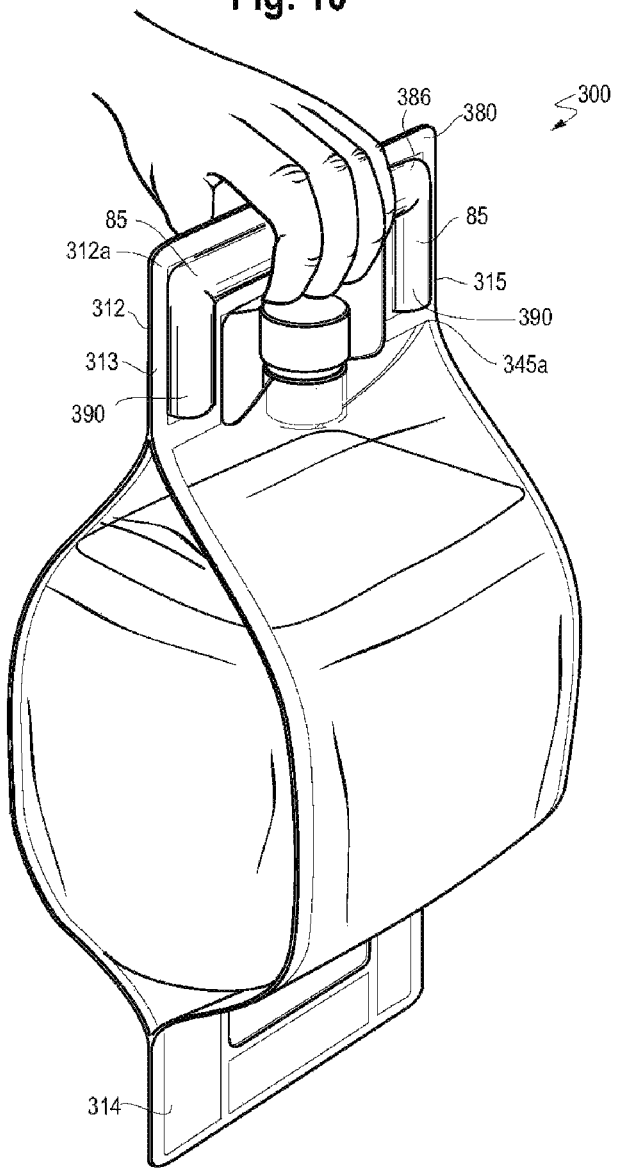
FIG. 10 is a perspective view of a flexible container in accordance with an embodiment of the present disclosure.

FIG. 10 depicts a flexible container 300, which includes a top handle 312 located at the top end of the chamber 345*a*, the top handle 312 including a pocket 386 containing a pre-formed hollow tube grip member 390. The top handle 312 is formed from a handle seal 380. The top handle 312 includes a pair of legs 313, 315, and an upper handle portion 312*a*. The upper handle portion 312*a* and each of the legs 313, 315 includes a U-shaped pocket 85. A pre-formed hollow tube grip member 390 is contained within the U-shaped pocket 85, indicating the pre-formed hollow tube grip member 390 is integral to the flexible container 300. The U-shaped pocket 85 extends the length of the upper handle portion 312*a* and into at least a portion of each of the legs 313, 315. The pre-formed hollow tube grip member 390 contained in the U-shaped pocket 85 extends the length of the upper handle portion 312*a* and into at least a portion of each of the legs 313, 315. The pre-formed hollow tube grip member 390 that extends into at least a portion of each of the legs 313, 315 provides structural support for the top handle 312, and provides comfort for a user. The flexible container 300 also includes a bottom handle 314, which does not include a grip member.

Although FIG. 10 shows flexible container 300 with a top handle 312 including a U-shaped pocket 85, it is understood the flexible container 300 may include a bottom handle 314 with a U-shaped pocket, alone, or in combination with, the top handle 312.

FIG. 11 depicts a flexible container 100 with a top handle 112 located at the top end of the chamber 145*a* and a bottom handle 114 located at the bottom end of the chamber 145*b*, each handle 112, 114 containing a short pocket 181*a*, 181*b* that contains a pre-formed hollow tube grip member 190*a*, 190*b*. The top handle 112 is formed from a handle seal 180*a* and 112 includes a pair of legs 113, 115 and an upper handle portion 112*a*. The top handle 112 contains a flap portion 136 that includes a short pocket 181*a*. A pre-formed hollow tube grip member 190*a* is contained within the short pocket 181*a*, indicating the pre-formed hollow tube grip member 190*a* is integral to the flexible container 100. The bottom handle 114 is formed from a handle seal 180*b* and includes a pair of legs 117, 119 (not shown), and a lower handle portion 114*a*. The bottom handle 114 contains a flap portion 138 that includes a short pocket 181*b*. A pre-formed hollow tube grip member 190*b* is contained within the short pocket 181*b*, indicating the grip member 190*b* is integral to the flexible container 100. Thus, the top handle 112 and the bottom handle 114 each include a pocket 186 containing a pre-formed hollow tube grip member 190*a*, 190*b*. As a user pours product 158 out of the flexible container 100, the user may advantageously hold both the top handle 112 and the bottom handle 114, with each of the top handle 112 and the bottom handle 114 containing a pre-formed hollow tube grip member that cushions each respective handle. The pre-formed hollow tube grip members 190*a*, 190*b* provide support for the handles 12, 14, with each pre-formed hollow tube grip member 190*a*, 190*b* preventing the respective handle 12, 14 from deforming against the weight of the product 158 contained in the flexible container 300.

Figure 12:
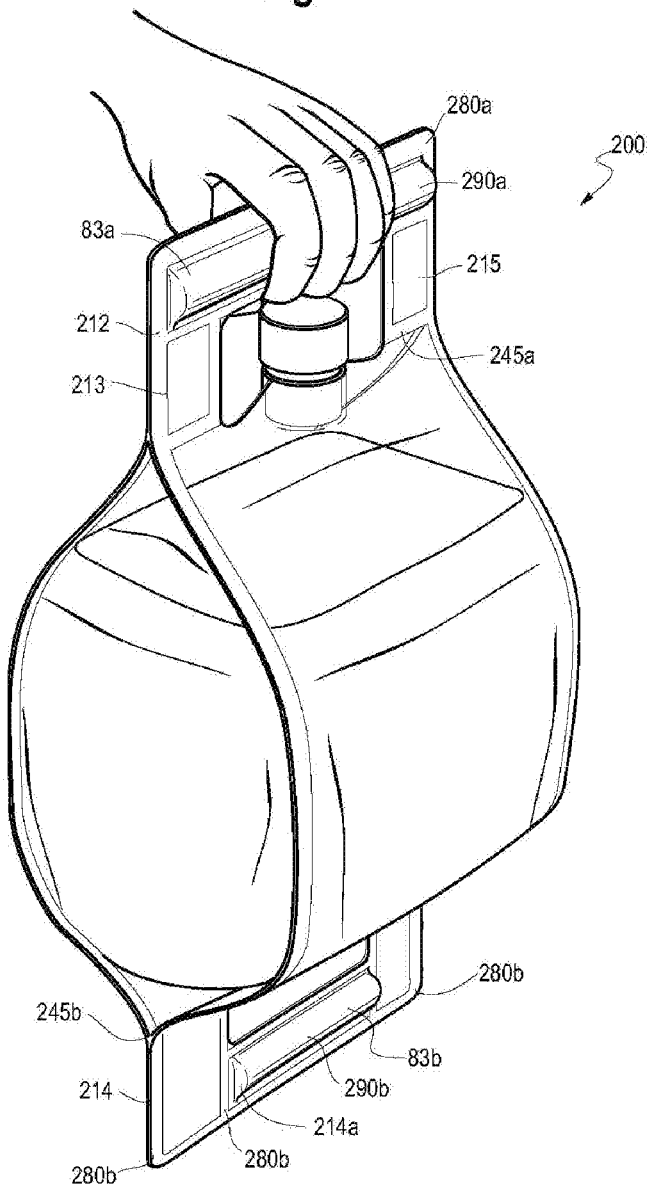
FIG. 12 is a perspective view of a flexible container in accordance with an embodiment of the present disclosure.

FIG. 12 depicts a flexible container 200 with a top handle 212 located at the top end of the chamber 245*a* and a bottom handle 214 located at the bottom end of the chamber 245*b*, each handle 212, 214 containing a long pocket 83*a*, 83*b* that contains a pre-formed hollow tube grip member 290*a*, 290*b*. The top handle 212 is formed from a handle seal 280*a* and includes a pair of legs 213, 215, and an upper handle portion 212*a*. The upper handle portion 212*a* includes a long pocket 83*a*. The pre-formed hollow tube grip member 290*a* is contained within the long pocket 83*a*, indicating the pre-formed hollow tube grip member 290*a* is integral to the flexible container 200. The bottom handle 214 is formed from a handle seal 280*b* and includes a pair of legs 217, 219, and a lower handle portion 214*a*. The lower handle portion 214*a* includes a long pocket 83*b*. The pre-formed hollow tube grip member 290*b* is contained within the long pocket 83*b*, indicating the pre-formed hollow tube grip member 190*b* is integral to the flexible container 200. The long pocket 83*a*, 83*b* may or may not extend the length of the upper handle portion 212*a* (for the top handle 212) or the lower handle portion 214*a* (for the bottom handle 214). FIG. 12 depicts a long pocket 83*a* in the top handle 212 extending the length of the upper handle portion 212*a*, and a long pocket 83*b* in the bottom handle 214 that does not extend the entire length of the lower handle portion 214*a*.

Although FIG. 12 shows flexible container 200 with both a top handle 212 and a bottom handle 214, it is understood the flexible container 200 may have a single handle, either a top handle 212 or a bottom handle 214.

ii. Foam Grip Member

In an embodiment, the grip member 90 is a foam. A "foam" is a flexible cellular material composed of a matrix with void cells dispersed throughout the matrix. The foam may be fabricated prior to, during, or after placement in the pocket. Nonlimiting examples of suitable material includes polyurethane, rubber latex, polyethylene, ethylene/propylene/diene terpolymer, acrylonitrile/butadiene copolymer, and vinyl polymers. In an embodiment, the foam is a polyurethane foam. In another embodiment, the foam is a polyethylene foam.

Figure 9:
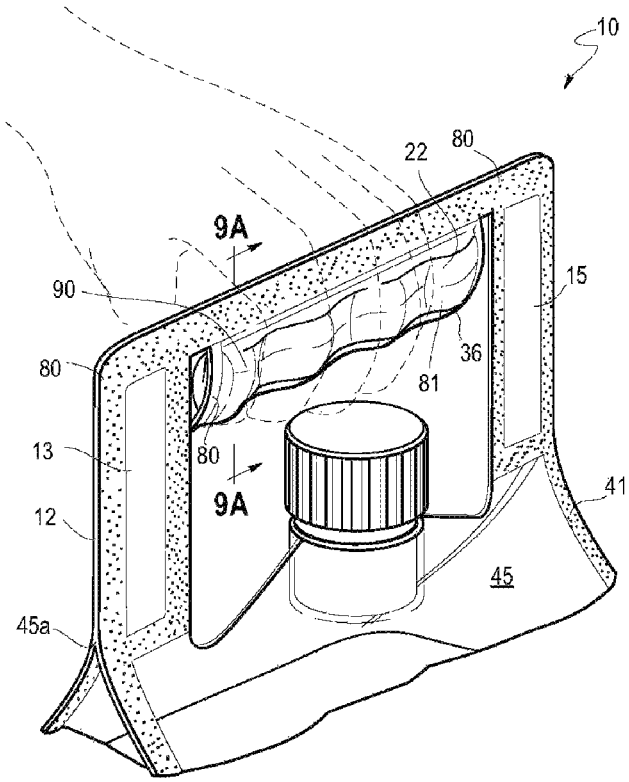
FIG. 9 is an enlarged perspective view of a handle in accordance with another embodiment of the present disclosure.
Figure 9A:
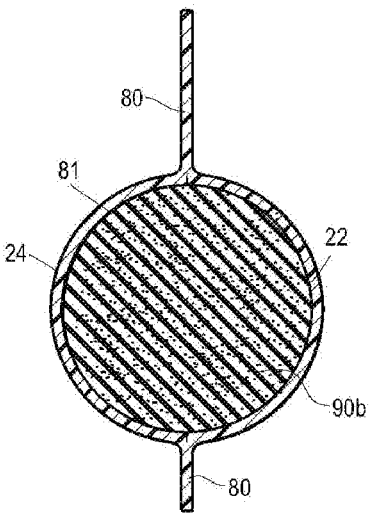
FIG. 9A is a sectional view taken along the line 9A-9A of FIG. 9 in accordance with an embodiment of the present disclosure.

In an embodiment, the foam is produced by injecting the foam components (including a crosslinking agent and/or a blowing agent) into the pocket. The components may then be expanded, such as by heat expansion, to form the foam in the pocket in situ. In another embodiment, the foam is fabricated prior to placement in the pocket—thus, in an embodiment, the foam is a pre-formed foam. FIG. 9A depicts a sectional view of a short pocket 81 formed from the front panel 22 and the rear panel 24 and the handle seal 80, the short pocket containing a foam grip member 90*b*. The foam grip member 90*b* is contained within the short pocket 81, indicating the foam grip member 90*b* is integral to the flexible container 10. The foam grip member 90*b* is malleable. When a user grasps the top handle 12 with a short pocket 81 containing the foam grip member 90*b*, the flap portion 36 folds upwards toward the upper handle portion 12*a* of the top handle 12 and the foam grip member 90*b* contours to the user's hand, to create a smooth gripping surface of the top handle 12, and the foam grip member 90*b* creates a cushioned gripping surface of the top handle 12. The foam grip member 90*b* conforms to the shape of the user's hand, as shown in FIG. 9.

iii. Gel Grip Member

Figure 9B:
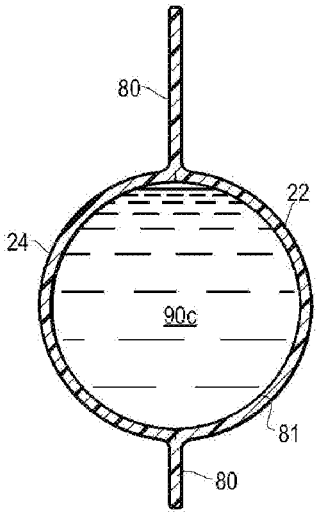
FIG. 9B is a sectional view taken along the line 9A-9A of FIG. 9 in accordance with an embodiment of the present disclosure.

In an embodiment, the grip member 90 is a gel. A "gel" is a substantially dilute cross-linked system that exhibits no flow when in the steady-state. A gel is a solid jelly-like material. Nonlimiting examples of suitable gels include silicone, glycerin, neoprene, hydrogel, and organogel. FIG. 9B depicts a sectional view of a short pocket 81 formed from the front panel 22 and the rear panel 24 and the handle seal 80, the short pocket containing a gel grip member 90*c*. The gel grip member 90*c* is contained within the short pocket 81, indicating the gel grip member 90*c* is integral to the flexible container 10. The gel grip member 90*c* is malleable. When a user grasps the top handle 12 with a short pocket 81 containing the gel grip member 90*c*, the flap portion 36 folds upwards toward the upper handle portion 12*a* of the top handle 12 and the gel grip member 90*c* contours to the user's hand, to create a smooth gripping surface of the top handle 12, and the gel grip member 90*c* creates a cushioned gripping surface of the top handle 12. The gel grip member 90*c* conforms to the shape of the user's hand, as shown in FIG. 9.

iv. Gas Grip Member

Figure 9C:
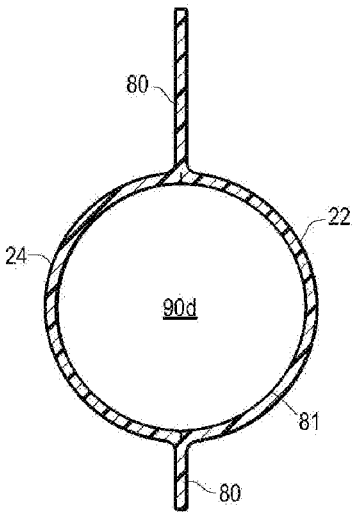
FIG. 9C is a sectional view taken along the line 9A-9A of FIG. 9 in accordance with an embodiment of the present disclosure.

In an embodiment, the grip member 90 is a gas. A "gas" is a substance present in the gaseous phase at room temperature (23° C.). Nonlimiting examples of suitable gas includes air and carbon dioxide. In an embodiment, the gas is air. FIG. 9C depicts a sectional view of a short pocket 81 formed from the front panel 22 and the rear panel 24 and the handle seal 80, the short pocket containing a gas grip member 90*d*. Gas is introduced into the void volume of the short pocket 81 to increase the inner volume of the short pocket 81. The gas grip member 90*d* is contained within the short pocket 81, indicating the gas grip member 90*d* is integral to the flexible container 10. The gas grip member 90*d* is malleable. When a user grasps the top handle 12 with a short pocket 81 containing the gas grip member 90*d*, the flap portion 36 folds upwards toward the upper handle portion 12*a* of the top handle 12 and the gas grip member 90*d* contours to the user's hand, to create a smooth gripping surface of the top handle 12, and the gas grip member 90*d* creates a cushioned gripping surface of the top handle 12. The gas grip member 90*d* conforms to the shape of the user's hand, as shown in FIG. 9.

A myriad of configurations for the top/bottom handle(s) are possible with the present flexible container by matching different pocket types alone or in combination with different grip member types. The top handle and/or the bottom handle may include one pocket, or a plurality of pockets. When the flexible container includes more than one pocket, each pocket may be the same or different, and selected from a short pocket, a long pocket, a side pocket, and/or a U-shaped pocket. For instance, the flexible container may include a top handle with a short pocket (attached to the upper handle portion or one of the legs) and a side pocket, and a bottom handle with a U-shaped pocket. Or, the flexible container may include a bottom handle with a long pocket, and a top handle without a pocket. The flexible container may include a top handle with two short pockets (such as one attached to each leg) and a long pocket, and a bottom handle with a short pocket (attached to the lower handle portion or one of the legs). The flexible container may include a top handle with one short pocket (attached to the upper handle portion or one of the legs) and a side pocket (in one leg), and a bottom handle without a pocket, as shown in FIG. 1A. Different arrays of grip members may be applied to the many pocket arrangements. In a flexible container with more than one pocket, each pocket may contain the same grip member, or a different grip member. For example, the flexible container may include two pockets, each pocket having the same type of grip member. Or, the flexible container may include a top handle with two short pockets (one attached to each leg) and a long pocket, and a bottom handle with a short pocket (attached to the lower handle portion or one of the legs), and each pocket individually contains a foam grip member. Alternatively, the flexible container includes two pockets and each pocket includes a different type of grip member. For instance, the flexible container may include a top handle with a short pocket (attached to the upper handle portion or one of the legs) containing a gel grip member and a side pocket containing a gas grip member, and a bottom handle with a U-shaped pocket containing a pre-formed tube grip member.

The flexible container may comprise two or more embodiments disclosed herein.

It is specifically intended that the present disclosure not be limited to the embodiments and illustrations contained herein, but include modified forms of those embodiments including portions of the embodiments and combinations of elements of different embodiments as come with the scope of the following claims.

We claim:

1. A flexible container comprising:

a front panel, a rear panel, a first gusseted side panel, and a second gusseted side panel, the gusseted side panels adjoining the front panel and the rear panel along (i) peripheral seals to form a chamber; and (ii) handle seals to form a handle having a U-shape, the handle located at an end of the chamber and comprising (a) two spaced apart legs extending from a horizontal upper handle portion;

(b) a flap portion extending below the upper handle portion, the flap portion having four sides, one side of the flap portion attached to the upper handle portion and three sides of the flap portion unattached from the handle;

(c) four handle seals extending along respective four sides of the flap portion, the four handle seals forming a closed pocket in the flap portion; and (d) the pocket comprising a grip member.

2. The flexible container of claim 1, wherein the chamber has a top end and a bottom end, and the handle is located at the top end of the chamber.

3. The flexible container of claim 1, wherein the chamber has a top end and a bottom end, and the handle is located at the bottom end of the chamber.

4. The flexible container of claim 1, wherein the chamber has a top end and a bottom end, and the flexible container comprises a top handle located at the top end of the chamber and a bottom handle located at the bottom end of the chamber.

5. The flexible container of claim 1, wherein the handle seals form a hermetic seal around the pocket comprising the grip member.

6. The flexible container of claim 1, wherein the pocket is a short pocket.

7. The flexible container of claim 1, wherein the handle further comprises a long pocket.

8. The flexible container of claim 1, wherein the handle further comprises a U-shaped pocket.

9. The flexible container of claim 1, wherein the handle further comprises a side pocket.

10. The flexible container of claim 1, wherein the handle comprises a long pocket and a short pocket, each pocket comprising a grip member.

11. The flexible container of claim 1, wherein the handle comprises a plurality of pockets.

12. The flexible container of claim 1, wherein the grip member is a pre-formed tube.

13. The flexible container of claim 1, wherein the grip member is a foam.

14. The flexible container of claim 1, wherein the grip member is a gel.

15. The flexible container of claim 1, wherein the grip member is a gas.

16. The flexible container of claim 1, wherein a handle seal extends along each leg, each leg handle seal comprising four plys of multilayer film including the front panel, the rear panel, the first gusseted side panel, and the second gusseted side panel sealed together.

17. The flexible container of claim 16, wherein a handle seal extends along the horizontal upper handle portion and comprises four plys of multilayer film including the front panel, the rear panel, the first gusseted side panel, and the second gusseted side panel sealed together.

18. The flexible contains of claim 17, wherein the edges of the front panel, the rear panel, the first gusseted side panel, and the second gusseted side panel are sealed to the adjacent panel to form peripheral seals and four peripheral tapered seals; and the four peripheral tapered seals converge in a bottom seal area comprising an overseal.

* * * * *